United States Patent [19]

Shivers

[11] Patent Number: 4,864,760

[45] Date of Patent: Sep. 12, 1989

[54] HAMMER LOCKING DEVICE FOR HANDGUN

[76] Inventor: Horace L. Shivers, 21 Fillmore St., Trenton, N.J. 08638

[21] Appl. No.: 260,770

[22] Filed: Oct. 21, 1988

[51] Int. Cl.[4] ..... F41C 17/00

[52] U.S. Cl. ..... 42/70.08; 42/70.11

[58] Field of Search ..... 42/70.11, 70.08

[56] References Cited

U.S. PATENT DOCUMENTS

| | | | |
|---|---|---|---|
| 290,867 | 12/1883 | Deyo | 42/70.08 |
| 561,963 | 6/1896 | Caldwell | 42/70.08 |
| 774,712 | 11/1904 | Vold | 42/70.08 |
| 835,349 | 11/1906 | Deming | 42/70.11 |
| 2,527,957 | 10/1950 | Phillips | 42/70.08 |
| 2,994,981 | 8/1961 | Carrigan | 42/70.08 |
| 3,422,560 | 1/1969 | Foote et al. | 42/70.07 |
| 3,624,945 | 12/1971 | Foute | 42/70.07 |
| 4,014,123 | 3/1977 | Williams | 42/70.11 |
| 4,299,045 | 11/1981 | Cerrantes | 42/70.11 |
| 4,392,318 | 7/1983 | Daniels | 42/70.11 |

FOREIGN PATENT DOCUMENTS 975770 11/1964 United Kingdom ..... 42/70.08

*Primary Examiner*—Deborah L. Kyle
*Assistant Examiner*—Michael J. Carone
*Attorney, Agent, or Firm*—Sperry, Zoda & Kane

[57] ABSTRACT

A device for facilitating quick and efficient selective locking of a handgun which includes a casing adapted to be secured to the butt end of a handgun which includes therein a plurality of rotatably movable locking rings which movability is controlled by a plurality of control knobs positioned on the other surface of the casing. Movement control between the knobs and the rings is achieved by a plurality of gearing means including a pinion shaft extending through the external surface of the casing. Preferably three such locking rings and control knob combination assemblies are included to allow for full and complete locking and yet facilitate ease of unlocking.

14 Claims, 4 Drawing Sheets

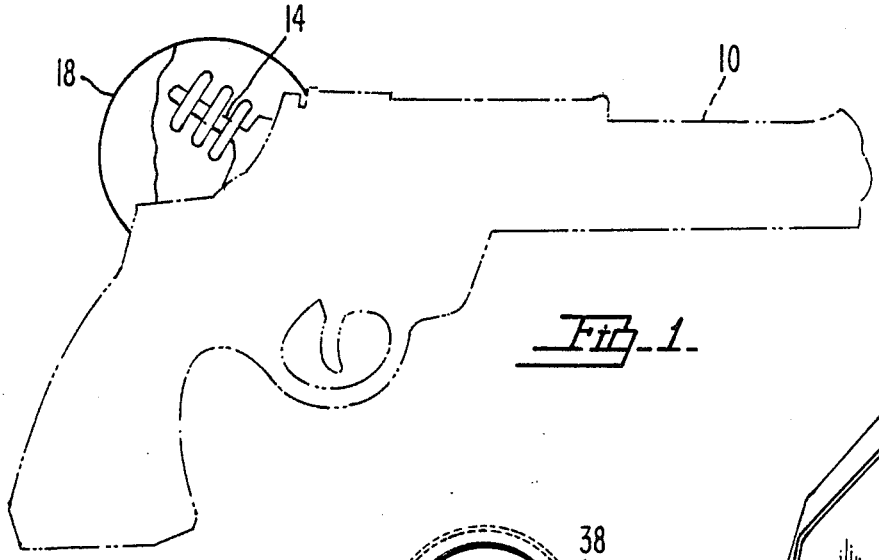
Fig. 1.
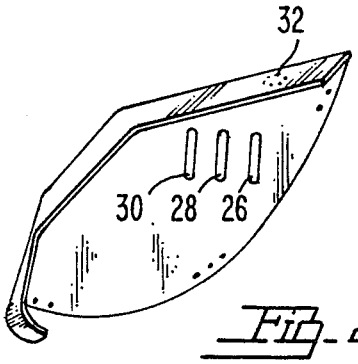
Fig. 2.
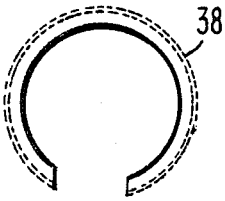
Fig. 3.
Fig. 4.
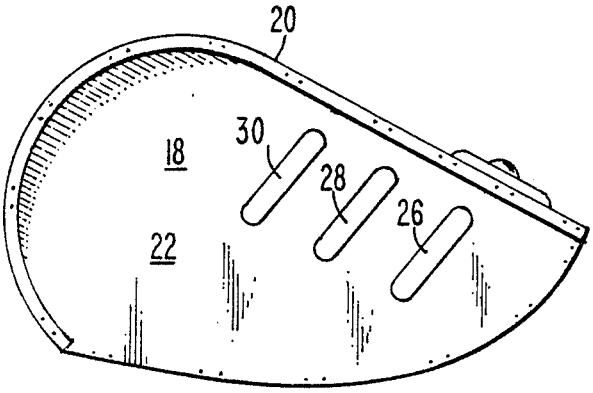
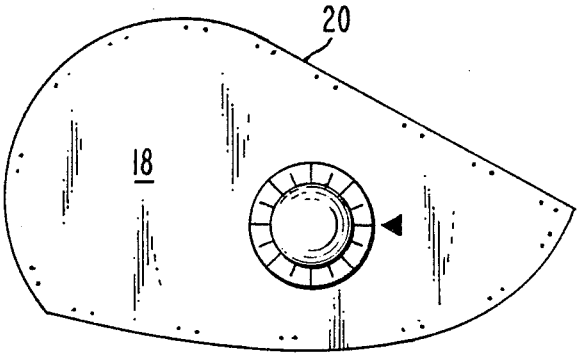
Fig. 5.
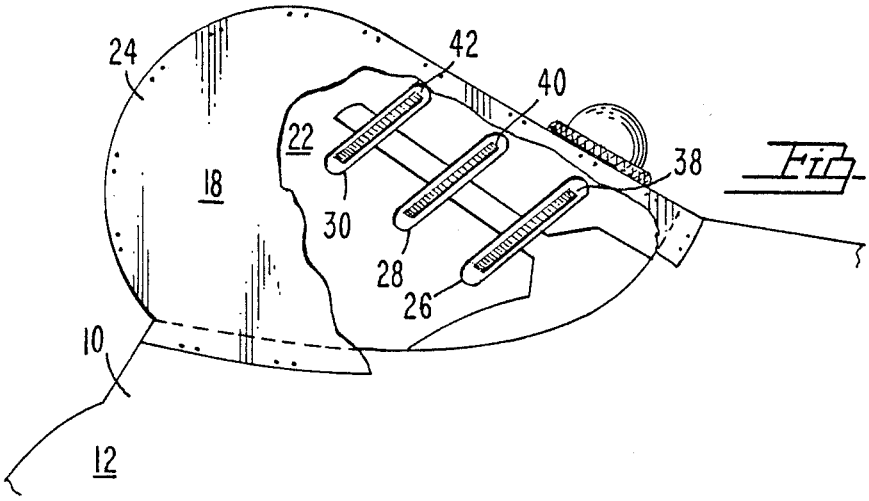
Fig. 6.

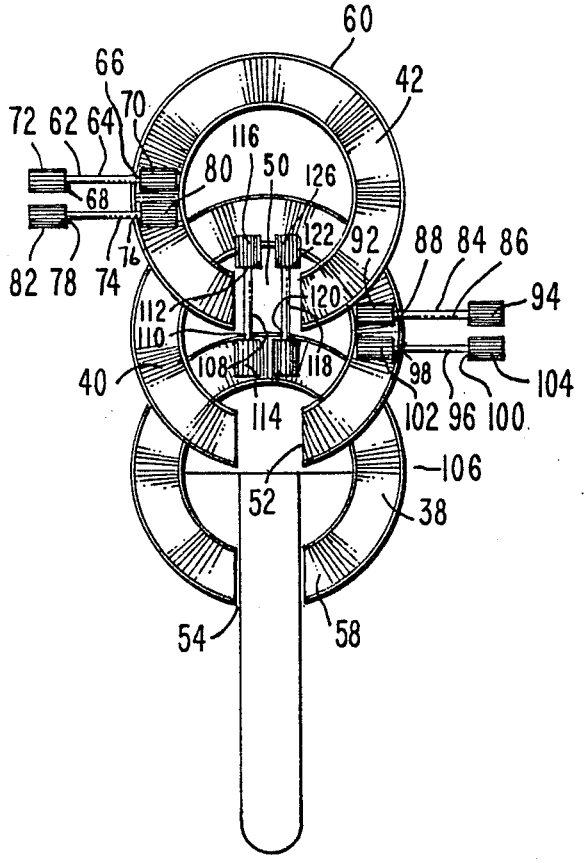
Fig. 7.
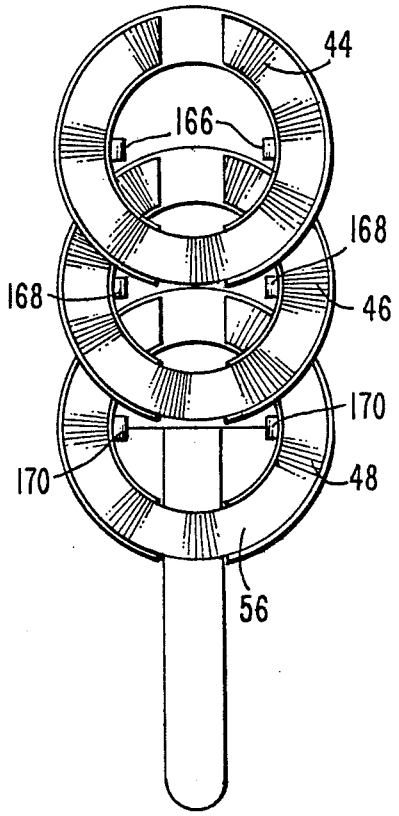
Fig. 8.
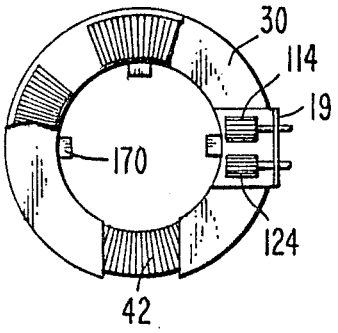
Fig. 9.
Fig. 10.
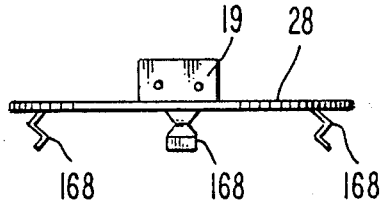
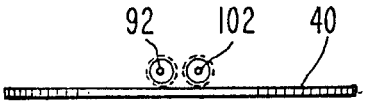
Fig. 11.

HAMMER LOCKING DEVICE FOR HANDGUN

BACKGROUND OF THE INVENTION

1. Field Of The Invention

The present invention deals with the field of devices for preventing the possibility of firing of a handgun without the knowledge and desire of the owner or user thereof. Such devices have been commonly used to prevent law enforcement officers from being victimized by their own gun or to keep children or other family members from being innocent victims of a handgun kept within the home.

2. Description Of The Prior Art

Prior art devices for controlling handgun usage include various configurations of safety locks, examples of which are shown in the following U.S. Pat. Nos. 561,963 issued June 16, 1896 to H. M. Caldwell on a Revolver; 774,712 issued Nov. 8, 1904 to O. 2,527,957 issued Oct. 31, 1950 to J. Phillips; 2,994,981 issued Aug. 8, 1961 to C. E. Carrigan; 3,422,560 issued Jan. 21, 1969 to T. C. Foote et al on Adjustable Gun Trigger Locks; 3,624,945 issued Dec. 7, 1971 to D. J. Foote on Universal Self-Conforming Trigger Lock For Firearms; 4,014,123 issued Mar. 29, 1977 to Coral C. Williams on a Firearm Safety Device and 4,299,045 issued Nov. 10, 1981 to Ramon H. Cervantes on a Backplate For A Detachable Gun Lock.

SUMMARY OF THE INVENTION

A hammer locking device is disclosed which is particularly usable with a handgun having a butt end with a thumb cock and hammer positioned therein. The hammer locking device includes a casing means which is adapted to be attachable with respect to the butt end of the handgun directly adjacent the thumb cock and hammer. The casing includes a top surface and a left and right side surface. The casing defines a first locking ring well means, a second ring well means and a third locking ring well means therein each extending generally about the thumb cock of the handgun. The casing also includes a plurality of top ball seats defining a top surface and a plurality of left side ball seats defined on the left surface and a plurality of right side ball seats defined in the right surface thereof.

A locking ring means is rotatably mounted within the locking ring well and extends about the thumb cock of the handgun to control movement. The locking ring includes a generally circular ring gear and defines a hammer slot therealong which is larger than the thumb cock of the handgun. The locking ring is rotatably movable between a closed position preventing movement of the hammer and thumb cock of the handgun and an opened position allowing release thereof.

The locking ring means further includes a first locking ring rotatably mounted within the first locking ring well extending about the thumb cock of the handgun for controlling movement. The first locking ring includes a generally circular first ring gear and the first locking ring further includes a first hammer slot defined circumferentially therealong being larger than the thumb cock of the handgun to facilitate movement thereof therethrough. The first locking ring is rotatably movable between a closed position preventing movement of the hammer and thumb cock of the handgun and an opened position allowing release thereof by movement through the first hammer slot.

In a similar fashion a second locking ring is rotatably positioned within the second locking ring well extending about the thumb cock of the handgun to control movement thereof. The second locking ring includes a generally circular second ring gear and defines a second hammer slot therealong larger than the thumb cock of the handgun. The second locking ring is rotatably movable between a closed position preventing movement of the hammer and thumb cock of the handgun and an opened position allowing release thereof by movement through the second hammer slot.

Furthermore the locking ring means includes a third locking ring rotatably positioned within the third locking ring well extending about the thumb cock of the handgun to control movement thereof. This third locking ring includes a generally circular third ring gear means and a third locking ring defines a third hammer slot therealong which is larger than the thumb cock of the handgun. The third locking ring is rotatably movable between a closed position preventing movement of the hammer and thumb cock of the handgun and an opened position allowing release thereof by movement through the third hammer slot.

A pinion means is defined extending through a pinion guide and a casing means adjacent each locking ring. The pinion means includes a first pinion assembly, a second pinion assembly and a third pinion assembly. Each pinion assembly includes two pinion shafts extending through the pinion guide support and casing parallel with respect to one another. These pinion shafts are referred to as the alpha and beta pinion shaft of each pinion assembly. Each alpha pinion shaft includes a first alpha inner end positioned within the locking ring well means and an alpha outer end located outside of the casing means. Each pinion assembly further includes an alpha inner pinion gear attached with respect to the alpha inner end of the pinion shaft and positioned in operative engagement with respect to the circular ring gear means associated therewith. The pinion assembly further includes an alpha outer pinion gear attached with respect to the alpha outer end of the alpha pinion shaft. A beta pinion shaft is further included rotatably mounted extending through the casing parallel with respect to the alpha pinion shaft and adjacent thereto. The beta pinion shaft includes a beta inner end positioned within the locking ring well means and a beta outer end located outside of the casing means. The beta inner pinion gear is attached with respect to the beta inner end of the beta pinion shaft and is positioned in operative engagement with respect to the circular ring gear means associated therewith. Furthermore a beta outer pinion gear is attached with respect to the beta outer end of the beta pinion shaft. This configuration is duplicated within the second pinion assembly and the third pinion assembly to facilitate effective control of all three locking ring gears.

A control means is rotatably mounted within the casing to control rotational movement of the locking rings within the locking ring wells. This control means includes a first control assembly having a first spindle and sleeve fixedly mounted on the top surface of the casing and a first control knob rotatably mounted with respect to the first spindle and sleeve. The first control knob includes a first outer rim member extending radially outwardly therefrom and a first ball means mounted therein adapted to selectively contact the top ball seats to detachably retain said first control knob in a desired position with respect thereto. A first toothed ring is secured to the first control knob to be rotatably movable therewith. The first toothed ring is positioned in engagement with respect to the first alpha outer pinion gear and the first beta outer pinion gear to facilitate effective control of rotational movement of the first locking ring means within the first locking ring well means by rotation of the first control assembly.

A second control assembly is similarly configured having a second spindle fixedly mounted on the left side surface of the casing and a second control knob rotatably mounted with respect to the second spindle. The second control knob includes a second outer rim member extending radially outwardly therefrom and a second ball mounted therein adapted to selectively contact the left side ball seats to detachably retain the second control knob in the desired position. A second toothed ring is secured to the second control knob to be rotatably movable therewith. The second toothed ring is positioned in engagement with respect to the second alpha outer pinion gear and the second beta outer pinion gear to facilitate effective control of rotational movement of the second locking ring within the second locking ring well means by rotation of the second control knob. A third control assembly is similarly included having a third spindle, a third control knob and a third toothed ring.

A tensioning means is included to facilitate engagement between the pinion means and the locking ring means which includes a first tensioning means positioned within the first locking ring well to facilitate engagement between the first locking ring and the first pinion assembly. A second tensioning means is positioned within the second locking ring well to facilitate engagement between the second locking ring and the second pinion assembly and a third tensioning means is positioned within the third locking ring well to similarly facilitate engagement between the third locking ring and the third pinion assembly.

It is an object of the present invention to provide a hammer locking device, for use with a handgun having a butt end with a thumb cock and hammer, wherein firing of a handgun is prevented without knowledge of the combination of each lock.

It is an object of the present invention to provide a hammer locking device, for use with a handgun having a butt end with a thumb cock and hammer, wherein law enforcement officers will not be victimized by his or her own gun.

It is an object of the present invention to provide a hammer locking device, for use with a handgun having a butt end with a thumb cock and hammer, wherein children or other family members will not become innocent victims of a handgun kept in the home.

It is an object of the present invention to provide a hammer locking device, for use with a handgun having a butt end with a thumb cock and hammer, wherein a locking device is provided with a plurality of rotatable locking rings positioned therein.

It is an object of the present invention to provide a hammer locking device, for use with a handgun having a butt end with a thumb cock and hammer, wherein a maximum locking condition can be achieved by rotating all three locking rings to the locked position.

It is an object of the present invention to provide a hammer locking device, for use with a handgun having a butt end with a thumb cock and hammer, wherein a medium locking configuration can be achieved by rotating two of the three locking rings to the locking position and rotating the other locking ring to the opened position.

It is an object of the present invention to provide a hammer locking device, for use with a handgun having a butt end with a thumb cock and hammer, wherein a minimum locking position can be achieved by rotating of one locking ring to the locking position and rotating the other two locking rings to the opened position.

It is an object of the present invention to provide a hammer locking device, for use with a handgun having a butt end with a thumb cock and hammer, wherein three locking means can all be moved to the opened position only responsive to a condition when the firearm is in a fully ready position for use.

It is an object of the present invention to provide a hammer locking device, for use with a handgun, which can be opened in the dark, with or without looking at the control knob, by means of a ball and seat.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a front plan view of an embodiment of a handgun showing an embodiment of the locking device of the present invention in partial broken-away illustration shown attached to the butt end thereof;

FIG. 2 is a side perspective view of an embodiment of the hammer locking device of the present invention;

FIG. 3 is a top plan view of an embodiment of a locking ring of the present invention;

FIG. 4 is a side plan view of an embodiment showing the left side of the casing of the present invention in a broken configuration;

FIG. 5 is a side plan view of the right side of a casing of the present invention;

FIG. 6 is a side plan view of a casing means of the hammer locking device of the present invention shown partially broken away;

FIG. 7 is a top plan view of the three locking rings of the present invention shown positioned in the three locking ring wells of the present invention with associated inner pinion gears in the opened position;

FIG. 8 is an illustration similar to that shown in FIG. 7 with the locking rings positioned in the closed position;

FIG. 9 is a top plan view of the third locking ring means in the third locking ring well means with the third pinion assembly shown with the cover;

FIG. 10 is a side plan view of the cover tensioning means of the present invention;

FIG. 11 is a side plan view of the second alpha and beta inner pinion gears shown in engagement with respect to the second locking ring in the second locking ring well associated therewith;

DETAILED DESCRIPTION OF THE PREFERRED EMBODIMENT

Figure 12:
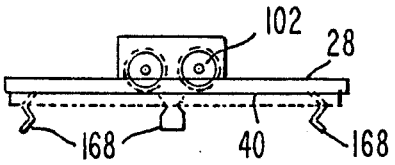
FIG. 12 is a side plan view of a Combination of the embodiments of the FIGS. 10 and 11 shown in mutual engagement.
Figure 13:
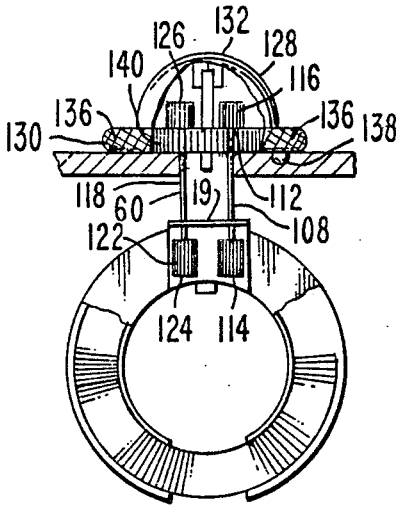
FIG. 13 is an illustration of the first pinion assembly extending between the first locking ring and the first control knob.
Figure 14:
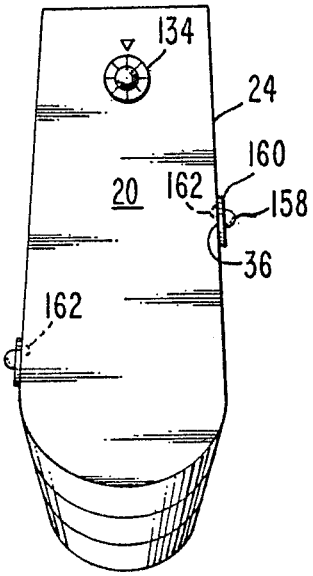
FIG. 14 is a top plan view of the hammer locking device of the present invention showing the three control knobs.
Figure 15:
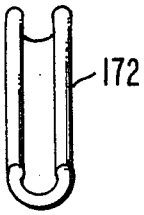
FIG. 15 is an illustration of the hammer extension device shown in the opened position.
Figure 16:
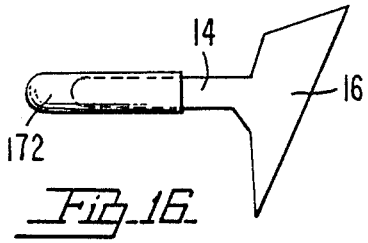
FIG. 16 is a further illustration of the hammer extension device of the present invention shown in the closed position grasping the thumb cock and hammer of a handgun.
Figure 17:
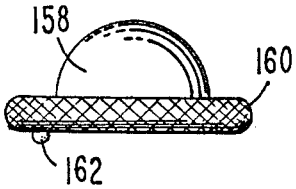
FIG. 17 is a side view of the third control knob.
Figure 18:
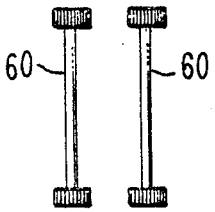
FIG. 18 is a side plan view of a pinion means.
Figure 19:
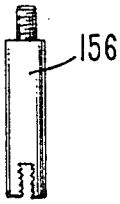
FIG. 19 is a side plan view of an embodiment of the spindle means of the present invention.
Figure 20:
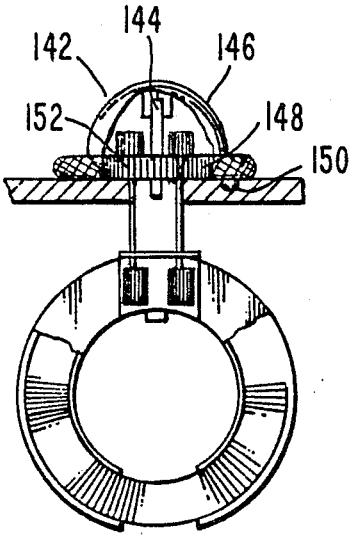
FIG. 20 is an illustration of the second pinion assembly extending between the second locking ring and the second control knob.
Figure 21:
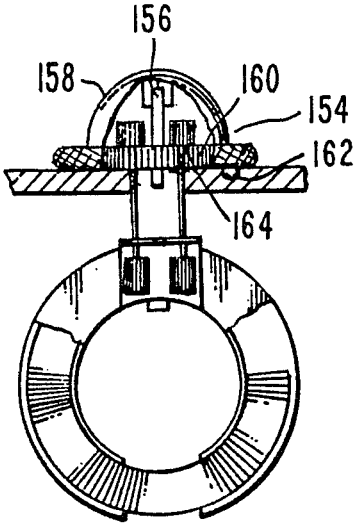
FIG. 21 is an illustration of the third pinion assembly extending between the third locking ring and the third control knob.

The present invention provides a locking device for use with a handgun 10 having a butt end 12 in which is positioned a movable hammer 16 with associated thumb cock 14 extending outwardly therefrom.

The present invention includes a casing means 18 adapted to be secured with respect to the butt end 12 of handgun 10. Casing means 18 includes a top surface 20, a left side surface 22 and a right side surface 24 each of which includes operative control of three separate locking means defined within the casing means 18.

Casing means 18 defines a first locking ring well means 26, a second locking ring well means 28 and a third locking ring well means 30 therein. Each locking ring well means is generally circular and is defined to extend about the thumb cock 14 of handgun 10. A first locking ring 38 is adapted to be positioned between the first locking ring well means 26. A second locking ring 40 is adapted to be positioned within the second locking ring well means 28 and a third locking ring 42 is adapted to be positioned within the third locking ring well means 30. Each of the locking rings 38, 40 and 42 are defined to be rotatably movable as mounted within the associated ring well means 26, 28 and 30. First locking ring 38 includes a first ring gear means 44 defined therein. Second locking ring 40 includes a second ring gear means 46 defined therein and third locking ring 42 includes a third ring gear means 48 defined therein. Each ring gear means includes an open hammer slot therein. In particular first ring gear means 44 includes a first hammer slot 50. Second ring gear means 46 includes a second hammer slot 52 and third ring gear means 48 includes a third hammer slot 54. The ring gear means are each rotatably movable along with the locking ring within the locking ring well means such that the hammer slot associated therewith can be oriented in a locking position which is not in alignment with respect to the thumb cock 14 or in an opened position which is in alignment with respect to the thumb cock 14 to facilitate movement thereof therethrough. The closed position is shown by reference numeral 56 and the opened position is shown by reference numeral 58.

A pinion means 60 is included in the present invention which includes a first pinion assembly 62, a second pinion assembly 84 and a third pinion assembly 106. First pinion assembly 62 includes a first alpha pinion shaft 64 and a first beta pinion shaft 74 both extending generally parallel with respect to one another through the pinion guide 19 and casing in the top surface 20. The first alpha pinion shaft includes a first alpha inner end 66 and a first alpha outer end 68. First pinion assembly 62 includes a first alpha inner pinion gear 70 secured with respect to the inner end 66 of first alpha pinion shaft 64. Similarly the pinion assembly 62 includes a first alpha outer pinion gear 72 secured with respect to the first alpha outer end 68 of first alpha pinion shaft 64. In similar fashion the first beta pinion shaft 74 includes a first beta inner end 76, a first beta outer end 78, a first beta inner pinion gear 80 and a first beta outer pinion gear 82.

A second pinion assembly 84 is similarly configured as the first pinion assembly 62. However it is located in the left side surface 22 of casing 18. The second pinion assembly 84 includes a second alpha pinion shaft 86, a second alpha inner end 88, a second alpha outer end 90, a second alpha inner pinion gear 92, a second alpha outer pinion gear 94, a second beta pinion shaft 96, a second beta inner end 98 and a second beta outer end 100. A second beta inner pinion gear 102 is included secured to the inner end 98 and a second beta outer pinion gear 104 is included secured with respect to the outer end 100.

A third pinion assembly is included similar in configuration to the first and second pinion assemblies which includes a third alpha pinion shaft 108, a third alpha inner end 110, a third alpha outer end 112, a third alpha inner pinion gear 114, a third alpha outer pinion gear 116, a third beta pinion shaft 118, a third beta inner end 120, a third beta outer end 122, a third beta inner pinion gear 124 and a third beta outer pinion gear 126.

Control means 128 includes a controlling system for operatively manipulating the positioning of the locking rings within the locking ring well means. The control means 128 includes a first control assembly 130 having a first spindle means 132 and sleeve with a first control knob 134 secured to the outer end thereof. A first outer rim 136 is defined on the first control knob and includes a first ball means 138 positioned in the undersurface thereof. A first toothed ring 140 is located within the first control knob 134 and is adapted to engage the first alpha outer pinion gear 72 and the first beta outer pinion gear 82 for controlling rotation of first beta pinion shaft 74 and first alpha pinion shaft 64.

A second control assembly 142 is further defined which includes a second spindle means 144 and sleeve and a second control knob 146. Second control knob 146 includes a second outer rim 148 with a second ball means 150 defined in the lower surface thereof. A second toothed ring 152 is defined within the second control knob 146 and is engageable with respect to the second alpha outer pinion gear 94 and the second beta outer pinion gear 104 to control movement thereof.

A third control assembly 154 is included having a third spindle means 156 and sleeve and a third control knob 158. A third outer rim 160 is defined in the outermost surface of the control knob 158 and includes a third ball means 162 positioned therein. A third toothed ring 164 is defined within the third control knob 158 and is in engagement with respect to the third alpha outer pinion gear 116 and the third beta outer pinion gear 126 to control operation thereof.

A first tensioning means 166 is positioned within the first locking ring well means 26 to facilitate gear engagement of the first locking ring 38 with respect to the inner pinion gears positioned thereadjacent. Similarly the second tensioning means 168 is defined within the second locking ring well means 28 to achieve effective engagement between the second ring gear 46 and the pinion gears in engagement therewith. Furthermore the third tensioning means 170 is positioned within the third locking ring well means 30 to facilitate secure engagement between the gearing of the third ring gear means 48 and the pinion gears thereadjacent.

To facilitate control o movement of the thumb cock of the handgun a thumb cock extension 172 may be positioned therearound for extension thereof to facilitate the locking or opened position achieved by the locking means extending therearound as desired.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A hammer locking device, for use with a handgun having a butt end with a thumb cock and hammer, comprising:

(a) a casing means adapted to be attachable with respect to the butt end of a handgun directly adjacent the thumb cock and hammer thereof, said casing means defining a locking ring well means therein extending about the thumb cock of the handgun;

(b) a locking ring means rotatably mounted within said locking ring well means and extending about the thumb cock of the handgun to control movement thereof, said locking ring means including a generally circular ring gear means and defining a hammer slot therealong being larger than the thumb cock of the handgun, said locking ring means being rotatably movable between a closed position preventing movement of the hammer and thumb cock of the handgun and an opened position allowing release thereof;

(c) a pinion means extending through said casing means adjacent said locking ring means and comprising:

(1) a pinion shaft rotatably mounted extending through said casing means, said pinion shaft including an inner end positioned within said locking ring well means and an outer end located outside of said casing means;

(2) an inner pinion gear attached with respect to said inner end of said pinion shaft and positioned in engagement with respect to said circular ring gear means;

(3) an outer pinion gear attached with respect to said outer end of said pinion shaft;

(d) a control means rotatably mounted on said casing means to control rotational movement of said locking ring means within said locking ring well means, said control means including:

(1) a control knob rotatably mounted with respect to said casing means on the exterior surface thereof; and (2) a toothed ring secured to said control to be rotatably movable therewith, said toothed ring being positioned in engagement with respect to said outer pinion gear to facilitate control of rotational movement of said locking ring means within said locking ring well means by rotation of said control knob.

2. A hammer locking device, for use with a handgun having a butt end with a thumb cock and hammer, as defined in claim 1 wherein said pinion means further comprises a pinion assembly which includes:

(a) an alpha pinion shaft rotatably mounted extending through said casing means, said alpha pinion shaft including an alpha inner end positioned within said locking ring well means and an alpha outer end located outside of said casing means;

(b) an alpha inner pinion gear attached with respect to said alpha inner end of said alpha pinion shaft and positioned in operative engagement with respect to said circular ring gear means;

(c) an alpha outer pinion gear attached with respect to said alpha outer end of said alpha pinion shaft;

(d) a beta pinion shaft rotatably mounted extending through said casing means, said beta pinion shaft including a beta inner end positioned within said locking ring well means and a beta outer end located outside of said casing means;

(e) a beta inner pinion gear attached with respect to said beta inner end of said secondary pinion shaft and positioned in operative engagement with respect to said circular ring gear means; and (f) a beta outer pinion gear attached with respect to said beta outer end of said beta pinion shaft.

3. A hammer locking device, for use with a handgun having a butt end with a thumb cock and hammer, as defined in claim 1 wherein said locking ring well means includes a first locking ring well, a second locking ring well and a third locking ring well, and wherein said locking ring means includes:

(a) a first locking ring rotatably positioned within said first locking ring well extending about the thumb cock of the handgun to control movement thereof, said first locking ring including a generally circular first ring gear means, said first locking ring defining a first hammer slot therealong being larger than the thumb cock of the handgun, said first locking ring being rotatably movable between a closed position preventing movement of the hammer and thumb cock of the handgun and an opened position allowing release thereof by movement through said first hammer slot;

(b) a second locking ring rotatably positioned within said second locking ring well extending about the thumb cock of the handgun to control movement thereof, said second locking ring including a generally circular second ring gear means, said second locking ring defining a second hammer slot therealong being larger than the thumb cock of the handgun, said second locking ring being rotatably movable between a closed position preventing movement of the hammer and thumb cock of the hand gun and an opened position allowing release thereof by movement through said second hammer slot; and (c) a third locking ring rotatably positioned within said third locking ring well extending about the thumb cock of the handgun to control movement thereof, said third locking ring including a generally circular third ring gear means, said third locking ring defining a third hammer slot therealong being larger than the thumb cock of the handgun, said third locking ring being rotatably movable between a closed position preventing movement of the hammer and thumb cock of the handgun and an opened position allowing release thereof by movement through said third hammer slot.

4. A hammer locking device, for use with a handgun having a butt end with a thumb cock and hammer, as defined in claim 3 wherein said pinion means further includes:

(a) a first pinion assembly further including:

(1) a first alpha pinion shaft rotatably mounted extending through said casing means, said first alpha pinion shaft including a first alpha inner end positioned within said first locking ring well means and a first alpha outer end located outside of said casing means;

(2) a first alpha inner pinion gear attached with respect to said first alpha inner end of said first pinion shaft and positioned in operative engagement with respect to said first circular ring gear means;

(3) a first alpha outer pinion gear attached with respect to said first alpha outer end of said (4) a first beta pinion shaft rotatably mounted extending through said casing means parallel with respect to said first alpha pinion shaft and adjacent thereto, said first beta pinion shaft including a first beta inner end positioned within said first locking ring well means and a first beta outer end located outside of said casing means;

(5) a first beta inner pinion gear attached with respect to said first beta inner end of said first beta pinion shaft and positioned in operative engagement with respect to said first circular ring gear means; and (6) a first beta outer pinion gear attached with respect to said first beta outer end of said first secondary pinion shaft;

(b) a second pinion assembly further including:

(1) a second alpha pinion shaft rotatably mounted extending through said casing means, said second alpha pinion shaft including a second alpha inner end positioned within said second locking ring well means and a second alpha outer end located outside of said casing means;

(2) a second alpha inner pinion gear attached with respect to said second alpha inner end of said second pinion shaft and positioned in operative engagement with respect to said second circular ring gear means;

(3) a second alpha outer pinion gear attached with respect to said second alpha outer end of said second alpha pinion shaft;

(4) a second beta pinion shaft rotatably mounted extending through said casing means parallel with respect to said second alpha pinion shaft and adjacent thereto, said second beta pinion shaft including a second beta inner end positioned within said second locking ring well means and a second beta outer end located outside of said casing means;

(5) a second beta inner pinion gear attached with respect to said second beta inner end of said second beta pinion shaft and positioned in operative engagement with respect to said second circular ring gear means; and (6) a second beta outer pinion gear attached with respect to said second beta outer end of said second secondary pinion shaft;

(c) a third pinion assembly further including:

(1) a third alpha pinion shaft rotatably mounted extending through said casing means, said third alpha pinion shaft including a third alpha inner end positioned within said third locking ring well means and a third alpha outer end located outside of said casing means;

(2) a third alpha inner pinion gear attached with respect to said third alpha inner end of said third pinion shaft and positioned in operative engagement with respect to said third circular ring gear means;

(3) a third alpha outer pinion gear attached with respect to said third alpha outer end of said third alpha pinion shaft;

(4) a third beta pinion shaft rotatably mounted extending through said casing means parallel with respect to said third alpha pinion shaft and adjacent thereto, said third beta pinion shaft including a third beta inner end positioned within said third locking ring well means and a third beta outer end located outside of said casing means;

(5) a third beta inner pinion gear attached with respect to said third beta inner end of said third beta pinion shaft and positioned in operative engagement with respect to said third circular ring gear means; and (6) a third beta outer pinion gear attached with respect to said third beta outer end of said third beta pinion shaft.

5. A hammer locking device, for use with a handgun having a butt end with a thumb cock and hammer, as defined in claim 4 wherein said control means includes:

(a) a first control assembly including:

(1) a first control knob rotatably mounted with respect to said casing means on the exterior surface thereof;

(2) a first toothed ring secured to said first control knob to be rotatably movable therewith, said first toothed ring being positioned in engagement with respect to said first alpha outer pinion gear and said first beta outer pinion gear to facilitate effective control of rotational movement of said first locking ring means within said first locking ring well means by rotation of said first control knob;

(b) a second control assembly including:

(1) a second control knob rotatably mounted with respect to said casing means on the exterior surface thereof;

(2) a second toothed ring secured to said second control knob to be rotatably movable therewith, said second toothed ring being positioned in engagement with respect to said second alpha outer pinion gear and said second beta outer pinion gear to facilitate effective control of rotational movement of said second locking ring means within said second locking ring well means by rotation of said second control knob; and (c) a third control assembly including:

(1) a third control knob rotatably mounted with respect to said casing means on the exterior surface thereof; and (2) a third toothed ring secured to said third control knob to be rotatably movable therewith, said third toothed ring being positioned in engagement with respect to said third alpha outer pinion gear and said third beta outer pinion gear to facilitate effective control of rotational movement of said third locking ring means within said third locking ring well means by rotation of said third control knob.

6. A hammer locking device, for use with a handgun having a butt end with a thumb cock and hammer, as defined in claim 5 further comprising:

(a) a first spindle means fixedly mounted in said casing, said first control knob being rotatably mounted thereon;

(b) a second spindle means fixedly mounted on said casing, said second control knob being rotatably mounted thereon; and (c) a third spindle means fixedly mounted in said casing, said third control knob being rotatably mounted thereon.

7. A hammer locking device, for use with a handgun having a butt end with a thumb cock and hammer, as defined in claim 6 wherein said casing means includes a top surface, a left side surface and a right side surface, and further wherein said first spindle means is mounted in said top surface and said second spindle means is mounted in said left side surface and said third spindle means is mounted in said right side surface.

8. A hammer locking device, for use with a handgun having a butt end with a thumb cock and hammer, as defined in claim 1 wherein said toothed ring on said control knob further includes ring gear teeth peripherally along the concave inside thereof.

9. A hammer locking device, for use with a handgun having a butt end with a thumb cock and hammer, as defined in claim 1 wherein said control knob includes an outer rim member extending radially outwardly thereof, said outer rim member including a ball means mounted therein adapted to selectively abut said casing means to detachably retain said control knob with respect thereto.

10. A hammer locking device, for use with a handgun having a butt end with a thumb cock and hammer, as defined in claim 9 wherein said casing means includes a plurality of ball seats defined therein positioned adjacent said outer rim member of said control knob and adapted to receive said ball means extending at least partially therein to selectively retain said control knob at a desired position.

11. A hammer locking device, for use with a handgun having a butt end with a thumb cock and hammer, as defined in claim 1 further including a spindle means fixedly mounted in said casing means, said control knob being rotatably mounted thereon to facilitate operative movement thereof.

12. A hammer locking device, for use with a handgun having a butt end with a thumb cock and hammer, as defined in claim 1 further including tensioning means positioned within said locking ring well means to facilitate engagement between said pinion means and said locking ring means.

13. A hammer locking device, for use with a handgun having a butt end with a thumb cock and hammer, as defined in claim 1 further comprising a thumb cock extension smaller than said hammer slot and secured with respect to said thumb cock and extending outwardly therefrom through said locking ring means to facilitate selective locking thereof.

14. A hammer locking device, for use with a handgun having a butt end with a thumb cock and hammer, comprising:

(a) a casing means adapted to be attachable with respect to the butt end of a handgun directly adjacent the thumb cock and hammer thereof, said casing means including a top surface, a left side surface and a right side surface, said casing means defining a first locking ring well means, a second locking ring well means and a third locking ring well means therein each extending about the thumb cock of the handgun, said casing means includes a plurality of top ball seats, a plurality of left side ball seats and a plurality of right side ball seats defined therein;

(b) a locking ring means rotatably mounted within said locking ring well means and extending about the thumb cock of the handgun to control movement thereof, said locking ring means including a generally circular ring gear means and defining a hammer slot therealong being larger than the thumb cock of the handgun, said locking ring means being rotatably movable between a closed position preventing movement of the hammer and thumb cock of the handgun and an opened position allowing release thereof, said locking ring means further including:

(1) a first locking ring rotatably positioned within said first locking ring well extending about the thumb cock of the handgun to control movement thereof, said first locking ring including a generally circular first ring gear means, said first locking ring defining a first hammer slot therealong being larger than the thumb cock of the handgun, said first locking ring being rotatably movable between a closed position preventing movement of the hammer and thumb cock of the handgun and an opened position allowing release thereof by movement through said first hammer slot;

(2) a second locking ring rotatably positioned within said second locking ring well extending about the thumb cock of the handgun to control movement thereof, said second locking ring including a generally circular second ring gear means, said second locking ring defining a second hammer slot therealong being larger than the thumb cock of the handgun, said second locking ring being rotatably movable between a closed position preventing movement of the hammer and thumb cock of the handgun and an opened position allowing release thereof by movement through said second hammer slot;

(3) a third locking ring rotatably positioned within said third locking ring well extending about the thumb cock of the handgun to control movement thereof, said third locking ring including a generally circular third ring gear means, said third locking ring defining a third hammer slot therealong being larger than the thumb cock of the handgun, said third locking ring being rotatably movable between a closed position preventing movement of the hammer and thumb cock of the handgun and an opened position allowing release thereof by movement through said third hammer slot;

(c) a pinion means extending to a position adjacent said locking ring means and including:

(1) a first pinion assembly further including:

(a) a first alpha pinion shaft rotatably mounted extending through said casing means, said first alpha pinion shaft including a first alpha inner end positioned within said first locking ring well means and a first alpha outer end located outside of said casing means;

(b) a first alpha inner pinion gear attached with respect to said first alpha inner end of said first pinion shaft and positioned in operative engagement with respect to said first circular ring gear means;

(c) a first alpha outer pinion gear attached with respect to said first alpha outer end of said first alpha pinion shaft;

(d) a first beta pinion shaft rotatably mounted extending through said casing means parallel with respect to said first alpha pinion shaft and adjacent thereto, said first beta pinion shaft including a first beta inner end positioned within said first locking ring well means and a first beta outer end located outside of said casing means;

(e) a first beta inner pinion gear attached with respect to said first beta inner end of said first beta pinion shaft and positioned in operative engagement with respect to said first circular ring gear means; and (f) a first beta outer pinion gear attached with respect to said first beta outer end of said first beta pinion shaft;

(2) a second pinion assembly further including:

(a) a second alpha pinion shaft rotatably mounted extending through said casing means, said second alpha pinion shaft including a second alpha inner end positioned within said second locking ring well means and a second alpha outer end located outside of said casing means;

(b) a second alpha inner pinion gear attached with respect to said second alpha inner end of said second pinion shaft and positioned in operative engagement with respect to said second circular ring gear means;

(c) a second alpha outer pinion gear attached with respect to said second alpha outer end of said second alpha pinion shaft;

(d) a second beta pinion shaft rotatably mounted extending parallel with respect to said second alpha pinion shaft and adjacent thereto, said second beta pinion shaft including a second beta inner end positioned within said second locking ring well means and a second beta outer end located outside of said casing means;

(e) a second beta inner pinion gear attached with respect to said second beta inner end of said second beta pinion shaft and positioned in operative engagement with respect to said second circular ring gear means;

(f) a second beta outer pinion gear attached with respect to said second beta outer end of said second secondary pinion shaft;

(3) a third pinion assembly further including:

(a) a third alpha pinion shaft rotatably mounted extending through said casing means, said third alpha pinion shaft including a third alpha inner end positioned within said third locking ring well means and a third alpha outer end located outside of said casing means;

(b) a third alpha inner pinion gear attached with respect to said third alpha inner end of said third pinion shaft and positioned in operative engagement with respect to said third circular ring gear means;

(c) a third alpha outer pinion gear attached with respect to said third alpha outer end of said third alpha pinion shaft;

(d) a third beta pinion shaft rotatably mounted extending through said casing means parallel with respect to said third alpha pinion shaft and adjacent thereto, said third beta pinion shaft including a third beta inner end positioned within said third locking ring well means and a third beta outer end located outside of said casing means;

(e) a third beta inner pinion gear attached with respect to said third beta inner end of said third beta pinion shaft and positioned in operative engagement with respect to said third circular ring gear means;

(f) a third beta outer pinion gear attached with respect to said third beta outer end of said third secondary pinion shaft;

(d) a control means rotatably mounted on said casing means to control rotational movement of said locking ring means within said locking ring well means, said control means including:

(1) a first control assembly including:

(a) a first spindle means fixedly mounted on said top surface of said casing;

(b) a first control knob rotatably mounted with respect to said first spindle means, said first control knob including a first outer rim member extending radially outwardly therefrom and a first ball means mounted therein adapted to selectively contact said top ball seats to detachably retain said first control knob in a desired position with respect thereto;

(c) a first toothed ring secured to said first control knob to be rotatably movable therewith, said first toothed ring being positioned in engagement with respect to said first alpha outer pinion gear and said first beta outer pinion gear to facilitate effective control of rotational movement of said first locking ring means within said first locking ring well means by rotation of said first control knob;

(2) a second control assembly including:

(a) a second spindle means fixedly mounted on said left side surface of said casing;

(b) a second control knob rotatably mounted with respect to said second spindle means, said second control knob including a second outer rim member extending radially outwardly therefrom and a second ball means mounted therein adapted to selectively contact said left side ball seats to detachably retain said second control knob in a desired position with respect thereto;

(c) a second toothed ring secured to said second control knob to be rotatably movable therewith, said second toothed ring being positioned in engagement with respect to said second alpha outer pinion gear and said second beta outer pinion gear to facilitate effective control of rotational movement of said second locking ring means within said second locking ring well means by rotation of said second control knob;

(3) a third control assembly including:

(a) a third spindle means fixedly mounted on said right side surface of said casing;

(b) a third control knob rotatably mounted with respect to said third spindle means, said third control knob including a third outer rim member extending radially outwardly therefrom and a third ball means mounted therein adapted to selectively contact said right side ball seats to detachably retain said third control knob in a desired position with respect thereto;

(c) a third toothed ring secured to said third control knob to be rotatably movable therewith, said third toothed ring being positioned in engagement with respect to said third alpha outer pinion gear and said third beta outer pinion gear to facilitate effective control of rotational movement of said third locking ring means within said third locking ring well means by rotation of said third control knob;

(e) a tensioning means to facilitate engagement between said pinion means and said locking ring means comprising:

(1) a first tensioning means positioned within said first locking ring well to facilitate engagement between said first locking ring and said first pinion assembly;

(2) a second tensioning means positioned within said second locking ring well to facilitate engagement between said second locking ring and said second pinion assembly; and (3) a third tensioning means positioned within said third locking ring well to facilitate engagement between said third locking ring and said third pinion assembly.

* * * * *

UNITED STATES PATENT AND TRADEMARK OFFICE

CERTIFICATE OF CORRECTION

PATENT NO. : 4,864,760
DATED : Sept. 12, 1989
INVENTOR(S) : Horace L. Shivers

It is certified that error appears in the above-identified patent and that said Letters Patent is hereby corrected as shown below:

In the Abstract, line 6, change "other" to -- outer --.
Column 7, line 62, after "control" insert -- knob --.
Column 9, line 20, after the second occurrence of "said" insert -- first alpha pinion shaft; --.

Signed and Sealed this

Twenty-sixth Day of February, 1991

*Attest:*

HARRY F. MANBECK, JR.

*Attesting Officer*

*Commissioner of Patents and Trademarks*